US005165354A

United States Patent [19]

Wahlstrand

[11] Patent Number: 5,165,354

[45] Date of Patent: Nov. 24, 1992

[54] ARRANGEMENT IN A SEWING MACHINE SHUTTLE

[75] Inventor: Hans E. Wahlstrand, Huskvarna, Sweden

[73] Assignee: Aktiebolaget Electrolux, Stockholm, Sweden

[21] Appl. No.: 630,482

[22] Filed: Dec. 20, 1990

[30] Foreign Application Priority Data

Jan. 10, 1990 [SE] Sweden ..... 9000075

[51] Int. Cl.[5] ..... D05B 57/14

[52] U.S. Cl. ..... 112/228

[58] Field of Search ..... 112/228, 231, 229, 230, 112/197, 199, 201, 202

[56] References Cited

U.S. PATENT DOCUMENTS

| | | | |
|---|---|---|---|
| 2,469,517 | 5/1949 | Petskeyes | 112/228 |
| 3,090,335 | 5/1963 | Bono | 112/231 |
| 3,097,619 | 7/1963 | Cerliani | 112/228 |

FOREIGN PATENT DOCUMENTS

| | | | |
|---|---|---|---|
| 0470513 | 5/1969 | Switzerland | 112/228 |

*Primary Examiner*—Peter Nerbun

*Attorney, Agent, or Firm*—Pearne, Gordon, McCoy & Granger

[57] ABSTRACT

Arrangement in a sewing machine shuttle for holding in place a hook ring (10) in a driver (19) consisting of three parts: an inner part (23), an intermediate part of spring material (24) and an outer part (25). The elastic intermediate part keeps the hook ring in a determined position but allows, at the same time, the passage of the upper thread without any considerable obstacle.

2 Claims, 1 Drawing Sheet

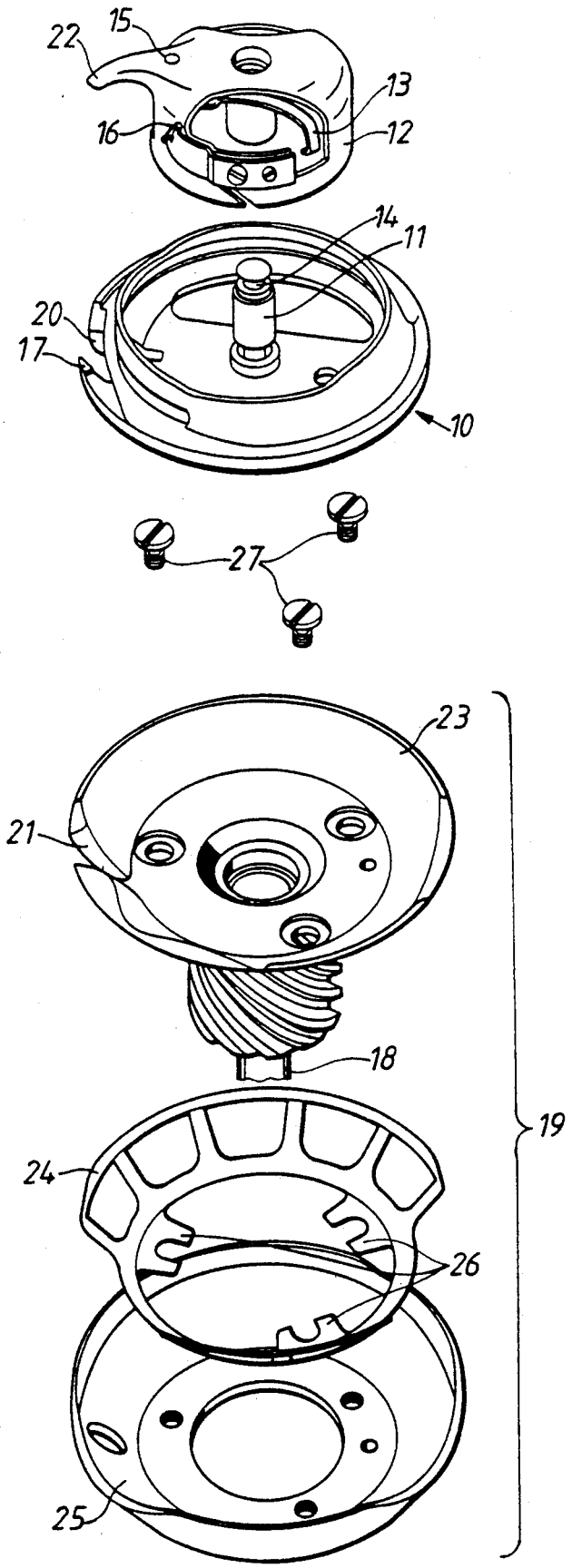
22
15
13
16
12
14
11
20
17
10
27
23
21
18
19
24
26
25

ARRANGEMENT IN A SEWING MACHINE SHUTTLE

BACKGROUND OF THE INVENTION

The present invention relates to a stabilizing member for a rotary hook in the shuttle mechanism below the stitch plate of a sewing machine.

Details of a shuttle mechanism in a sewing machine are often made of plastics, as those materials enable simple mass production and a ready mechanism working at a low noise level, as compared with a mechanism made in metal. However, as the hook must have a clearance from its driver in the mechanism, so that the upper thread can be carried through the mechanism in a correctly functional way when forming stitches, there will still be a rattling in the mechanism when the parts move against each other.

SUMMARY OF THE INVENTION

When trying to achieve a noiseless machine, steps have been taken to eliminate the rattling, one of those steps has resulted in the present invention, which uses a spring member to stabilize the rotary hook as described below.

BRIEF DESCRIPTION OF THE DRAWINGS

The FIGURE shows an exploded view of a shuttle mechanism.

DETAILED DESCRIPTION OF THE PREFERRED EMBODIMENT

An embodiment of the arrangement according to the invention is described in the following with reference to the attached drawing showing in a perspective sketch the parts of a shuttle mechanism one by one.

The mechanism shown contains a hook ring 10 with a horizontal shaft 11 and a bobbin case 12 laterally inserted and kept in place in the hook ring by a releasable latch 13 in engagement with a ring groove 14 at the end of the shaft. By turning the latch 13 around a pin 15, the bobbin case becomes disengaged. There is also an outlet 16 for the thread from a bobbin located in the bobbin case 12.

The hook ring 10 is rotated in the direction of its tip 17 by a driver 19 journalled on a shaft 18, and the driver is in its turn operated by the driving members of the machine via an angle gear or worm gear. A driving connection between the hook ring 10 and the driver 19 in the shape of a lug 20 on the hook and a recess 21 adapted to the lug on the driver bring about rotation of the hook ring. The bobbin case 12 is stationary, as a finger 22 on it engages a recess on the frame surrounding the hook. Thus far, the hook mechanism is of a conventional type and need not be described any further.

In the hook system described above, there is a gap between the driver and the hook ring. The hook ring carries, when forming stitches, a thread around itself and the thread runs in the gap mentioned. When sewing and also when no thread is on its way through the gap, the hook ring can wobble or shift in the gap causing a disturbing noise. In the example shown the driver consists of three parts, one inner part 23, one intermediate part 24 and one outer part 25, where the stabilizing means is constituted by the intermediate part. The intermediate part is a circular resilient spring member (in the following called a spring) which is suitably fastened between the inner and the outer parts of the driver and is here illustrated with tongues 26 between the parts 23, 25 joined by means of screws 27. In this assembled state the inside diameter of the spring is adjusted to the hook ring so that the hook ring rests against the spring. The force of the spring on the ring is sufficiently large to restrict the movement of the hook, and shocks or free play between the hook and the outer part of the driver will thus be avoided when sewing in a normal way. Simultaneously the spring is adapted in such a way that it allows the passage of the upper thread without any considerable obstacle. By inserting the spring, a source of noise from the hook has thus been eliminated. Experiments with such a shuttle mechanism provided with the spring described have shown that the stitch formation will not be influenced by the spring, as the hook carries the thread around itself in the usual way without the spring on the outer edge of the ring jamming the thread.

The arrangement described herein shall be regarded as only one embodiment of the invention.

Other embodiments adapted for other types of shuttles are also contemplated.

I claim:

1. An arrangement in a sewing machine shuttle provided with a rotary driver (19) and a hook ring (10) connected to it, which ring pulls, when forming stitches, a thread loop around itself through a gap arranged between the driver and the hook ring, comprising a resilient element (24) which engages both the driver and the hook ring, said element being constituted by a circular spring member (24) with at least one contact surface along the periphery of the hook ring by which the movement of the hook ring in the gap is limited so that there will be no shocks or free play between the hook ring and the driver when sewing, said resilient element also having fastening points (26) in the driver.

2. Arrangement according to claim 1, characterized in that the driver is a body assembled of parts of which one part constitutes a ring forming the spring member.

* * * * *